United States Patent [19]

Martin

[11] Patent Number: 4,981,087

[45] Date of Patent: Jan. 1, 1991

[54] METHOD FOR REGULATING THE FURNACE OUTPUT IN INCINERATION PLANTS

[75] Inventor: Johannes J. E. Martin, Munich, Fed. Rep. of Germany

[73] Assignee: Martin GmbH fur Umwelt-und Engerie-Technik, Munich, Fed. Rep. of Germany

[21] Appl. No.: 384,217

[22] Filed: Jul. 21, 1989

[30] Foreign Application Priority Data

Jul. 29, 1988 [DE] Fed. Rep. of Germany ..... 3825933

[51] Int. Cl.[5] ..... F23N 5/18

[52] U.S. Cl. ..... 110/186; 236/15 E; 431/76

[58] Field of Search ..... 236/15 B, 15 D, 15 F; 431/76, 12; 110/186, 190

[56] References Cited

U.S. PATENT DOCUMENTS 4,516,929 5/1985 Hiroi et al. ..... 236/15 E X 4,742,783 5/1988 La Spisa et al. ..... 431/76 X

FOREIGN PATENT DOCUMENTS 0119111 7/1984 Japan ..... 431/76

OTHER PUBLICATIONS

Anwendung Moderner Steuerungsund Automatisierungstechniken in Mullverbrennungsanlagen von Dip. Ing. Johannes Martin und W. Methfessel.

Erfahrungen zur Automatisierung der Feuerregelung bei der thermischen Abfallverwertung von Dieter O. Reimann.

*Primary Examiner*—William E. Wayner

*Attorney, Agent, or Firm*—McAulay Fisher Nissen & Goldberg

[57] ABSTRACT

The method for regulating the furnace output in incineration plants, particularly waste incineration plants, in which the $O_2$ moist content measured in the flue gas is used as an overriding reference value regulating variable for regulating the combustible material feed and the measured steam mass flow is used as a subordinate reference value regulating variable (10) for regulating the primary air supply, provides, according to a first variant, that the preselected $O_{2\,moist}$ reference value (7) is changed as a function of the furnace temperature (6) measured in the flue gas. This changed regulating variable (9) is fed to a regulator (13) which influences the combustible material feed and/or the grate drive.

3 Claims, 2 Drawing Sheets

METHOD FOR REGULATING THE FURNACE OUTPUT IN INCINERATION PLANTS

BACKGROUND OF THE INVENTION

1. Field of the Invention

The invention is directed to a method for regulating the furnace output in incineration plants, particularly waste incineration plants, in which the $O_{2\ moist}$ content measured in the flue gas is used as an overriding reference value regulating variable for regulating the combustible material feed and the measured steam mass flow or the furnace temperature measured in the combustion gas, as desired, is used as a subordinate reference value regulating variable for regulating the primary air supply.

2. Background Prior Art

In a known method of this type, the connection of thermal measured values, e.g. furnace temperature and steam mass flow, and material measured values, e.g. $O_{2\ moist}$ content, makes it possible, on the one hand, to keep the furnace output constant, i.e. to keep the steam mass flow constant, and on the other hand to minimize the emission of harmful material, i.e. to reduce the harmful material contained in the flue gas such as carbon monoxide, dust, hydrocarbons and nitric oxide. A fast-response regulation results from the use of the $O_{2\ moist}$ content as overriding regulating variable within such a regulating concept.

A disadvantage in this method is the fact that the $O_{2\ moist}$ content does not provide defined data about the $O_{2\ dry}$ content and, accordingly, about the true air surplus. However, the measurement of the $O_{2\ dry}$ content of the combustion gas is too inert and, under the existing operating conditions, too unreliable.

When the $O_{2\ moist}$ content, as overriding reference value, and the steam mass flow are kept constant, a shifting of the furnace temperature results during fluctuations in the moisture content of the flue gases. However, these fluctuations in the moisture content of the flue gases can not be avoided because of the sharply diverging composition of combustible material in waste incineration plants. This can lead to a worsening of the emission values at the adjusted and desired output.

On the other hand, if the furnace temperature is kept constant as overriding reference value at an $O_{2\ moist}$ content which is kept constant, a change in the steam mass flow results during fluctuations in the moisture content, which can lead to a worsening of the thermal utilization of the entire plant.

Because of the importance of the low emission values for the environment, the material values, i.e. the $O_{2\ moist}$ content, prevail over the thermal values, that is, the steam mass flow and the furnace temperature. Primary Object of the Invention Primary object of the invention is to optimize both the emission values and the furnace output proceeding from the two variants of the known method mentioned in the beginning.

This object can be met in two ways.

Proceeding from a method in which the $O_{2\ moist}$ content measured in the flue gas is used as an overriding reference value regulating variable for regulating the combustible material feed and the measured steam mass flow is used as a subordinate reference value regulating variable for regulating the primary air supply, the object is met in that the preselected $O_{2\ moist}$ reference value is changed as a function of the furnace temperature measured in the flue gas.

If, on the other hand, one proceeds from a method in which the $O_{2\ moist}$ content measured in the flue gas is used as an overriding reference value regulating variable for regulating the combustible material feed and the furnace temperature measured in the flue gas is used as a subordinate reference value regulating variable for regulating the primary air supply, the object is met in that the preselected $O_{2\ moist}$ reference value is changed as a function of the measured steam mass flow.

In implementing the first variant of the method, two temperature points are determined as limiting values, wherein the $O_{2\ moist}$ reference value is increased when the upper temperature value is exceeded, while the $O_{2\ moist}$ reference value is reduced when falling below the lower temperature limiting value. Thus, in the first case, the "apparent" air surplus is increased, while in the second case the "apparent" air surplus is reduced. However, the $O_{2\ moist}$ reference value is not influenced as long as the furnace temperature is within the selected limiting values.

The second variant is implemented in a similar manner, wherein two steam mass flow limiting values are selected instead of two temperature limiting values, the $O_{2\ moist}$ reference value being increased or reduced, respectively, when these values are exceeded or when falling below these values. Because of the particular importance of the emission values for the environment, priority is also given to the material values, i.e. the $O_{2\ moist}$ reference value, in the method according to the invention.

An even better regulating accuracy is achieved according to a preferred design of the method in that the rate of change of the measured temperature and steam mass flow values is taken into account in the change of the $O_{2\ moist}$ reference value. Thus, in this design the differential of the temperature change and of the steam mass flow change is considered over time, so that a change in the $O_{2\ moist}$ reference value can be carried out already before reaching the limiting values, so that the operation of the incineration plant is effected in an even more uniform manner because the regulation is more sensitive.

The invention is explained in the following with the aid of the diagrams shown by way of example in the drawing.

DESCRIPTION OF THE PREFERRED EMBODIMENTS

Figure 1:
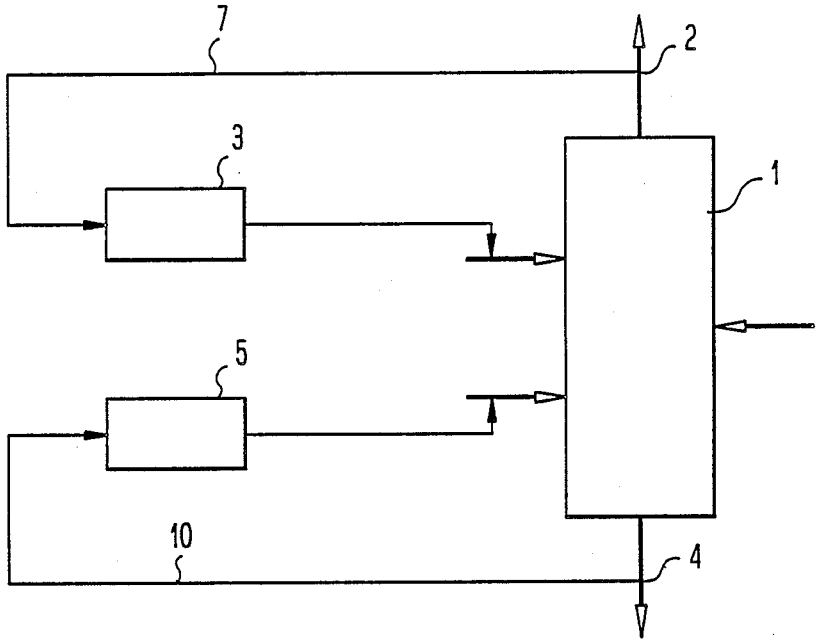
FIG. 1 shows a regulating diagram of a known type.

FIG. 1 explains the known method described in the beginning. According to this, the $O_{2\ moist}$ content measured in the flue gas 2 is used as an overriding regulating variable 7 for the purpose of regulating the furnace output of an incineration plant 1 comprising furnace and boiler, which regulating variable 7 is fed to a regulator 3 which acts on the feed device for charging the furnace with combustible material and/or on the stoking grate drive when this regulating variable deviates from a determined standard value band width.

The steam mass flow $m_D$ exiting from the boiler is simultaneously measured at 4 and this regulating variable 10 is fed to an additional regulator 5 which acts on the devices provided for adjusting the combustion air quantity, e.g. ventilator drive and control flaps in the air distribution system, when the measured value deviates from a preselected standard value band width of the steam mass flow.

The disadvantages of this regulating method were explained in the beginning.

Figure 2:
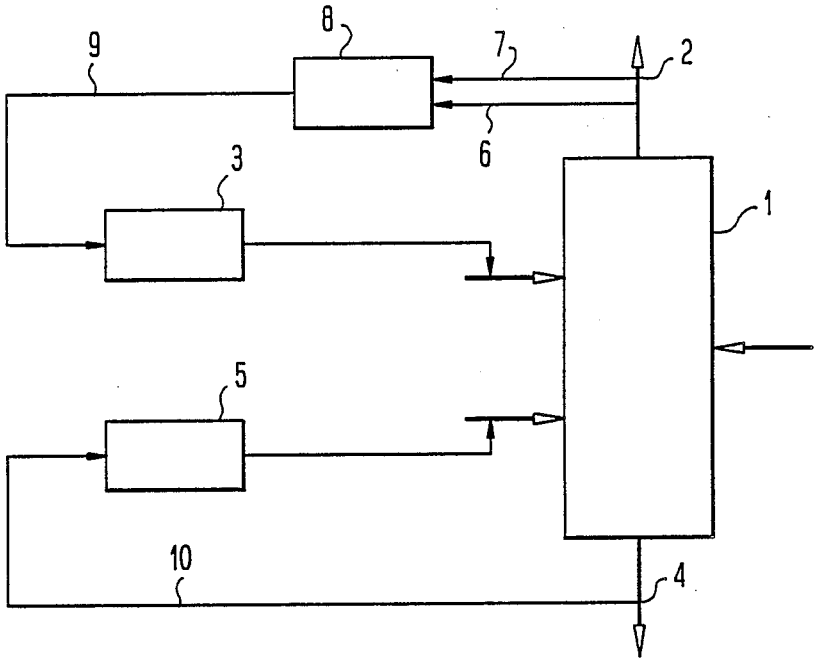
FIG. 2 shows a first regulating variant according to the invention.

In a first variant of the regulating method according to the invention, which is shown in FIG. 2, both the furnace temperature, as regulating variable 6, and the $O_{2\ moist}$ content, which is designated as measured value 7, are determined in the flue gas 2 exiting from the furnace system 1. The two values 6 and 7 are fed to a regulator 8. Proceeding from an operation which is to be viewed as particularly favorable and optimal, the measured $O_{2\ moist}$ content is viewed as a reference value. If a change occurs in the furnace temperature, wherein this change must lie above a preselected tolerance limit, the $O_{2\ moist}$ reference value is changed by means of the regulator 8. In so doing, the $O_{2\ moist}$ reference value is increased when the upper tolerance limit of the temperature value is exceeded, while the $O_{2\ moist}$ reference value is reduced when falling below the lower temperature tolerance limit. This modified $O_2$ moist reference value is then directed to the regulator 3 as regulating variable, which regulator 3 effects a change in the combustible material feed by means of acting on the feed device and/or effects a change in the grate speed by means of acting on the stoking grate drive. Thus, in contrast to the known method shown in FIG. 1, the regulator 3 is not acted upon by the measured $O_{2\ moist}$ value, rather it is acted upon by a $O_{2\ moist}$ reference value which is corrected as a function of the furnace temperature.

Simultaneously at 4, as is also the case in the method explained in FIG. 1, the measured steam mass flow $\dot{m}_D$ is fed to the regulator 5 as regulating variable 10, which regulator 5 monitors the combustion air supply, as in the known method.

Figure 3:
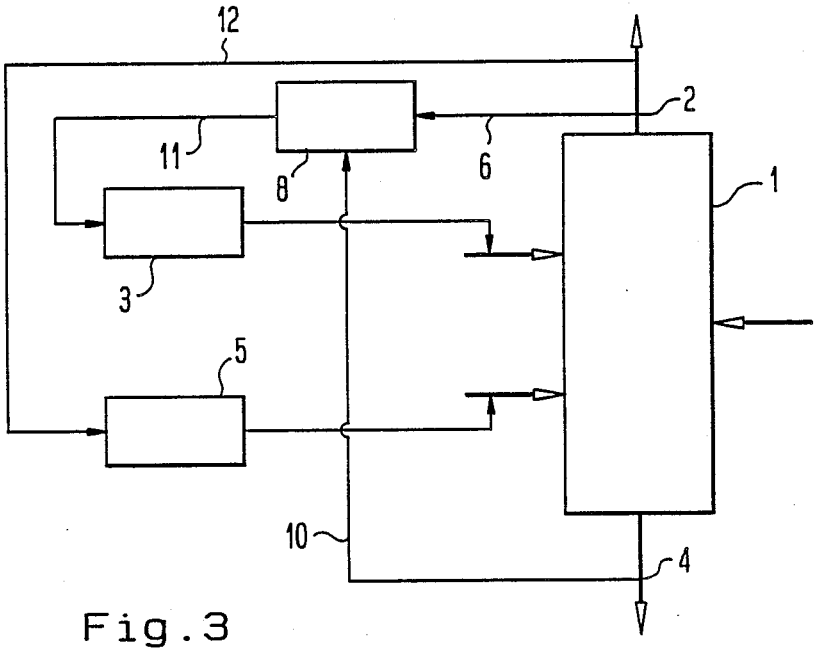
FIG. 3 shows a second regulating variant according to the invention.

In the second variant of the regulating method according to the invention, which is explained in FIG. 3, the measured $O_{2\ moist}$ measured value is utilized as a reference value, likewise proceeding from an operating state which is to be viewed as optimal. This measured value is likewise determined in the flue gas 2 which leaves the incineration plant 1 comprising furnace and boiler. This measured value 6 is fed to the regulator 8. Simultaneously, the regulator 8 obtains the steam mass flow $\dot{m}_D$ measured at 4 as regulating variable 10. The regulator 8 now changes the regulating variable 6 when the steam mass flow leaves a preselected standard value band width, specifically the $O_{2\ moist}$ reference value is increased when the upper steam mass flow limiting value is exceeded and the $O_{2\ moist}$ reference value is reduced when falling below the lower steam mass flow limiting value and is fed to the regulator 3 as a corrected regulating variable 11, the regulator 3 effecting a change in the combustible material feed and/or in the combustion grate speed when a corresponding deviation occurs. The furnace temperature measured in the flue gas is fed, as subordinate regulating variable 12, to the regulator 5 which monitors the quantity of the supplied combustion air.

While the foregoing description and drawings represent the preferred embodiments of the present invention, it will be obvious to those skilled in the art that various changes and modifications may be made therein without departing from the true spirit and scope of the present invention.

I claim:

1. In a method for regulating the furnace output in incineration plants, particularly waste incineration plants, in which the $O_{2\ moist}$ content measured in the flue gas is used as an overriding reference value regulating variable for regulating the combustible material feed and the measured steam mass flow is used as a subordinate reference value regulating variable for regulating the primary air supply, the improvement comprises: changing the preselected $O_{2\ moist}$ reference variable as a function of the furnace temperature measured in the combustion gas.

2. In a method for regulating the furnace output in incineration plants, particularly waste incineration plants, in which the $O_{2\ moist}$ content measured in the flue gas is used as an overriding reference value regulating variable for regulating the combustible material feed, and the furnace temperature measured in the flue gas is used as a subordinate reference value regulating variable for regulating the primary air supply, the improvement comprising: changing the preselected $O_{2\ moist}$ reference value is changed as a function of the measured steam mass flow.

3. A method according to claim 1 or 2, wherein the rate of change of the measured temperature or steam mass flow values is taken into account when changing the $O_{2\ moist}$ reference value.

* * * * *

UNITED STATES PATENT AND TRADEMARK OFFICE

CERTIFICATE OF CORRECTION

PATENT NO. : 4,981,087

DATED : January 1, 1991

INVENTOR(S) : Johannes J. E. Martin

It is certified that error appears in the above-indentified patent and that said Letters Patent is hereby corrected as shown below:

On the title page, Item [57] Abstract:

Line 3, "moist" should be subscript;

Line 13, after "drive.", insert -- (Fig. 2);

Column 1, lines 55-56, "Primary Object of the Invention" should be on a single line, in all captal letters, and there should be one blank line inserted both above and below it.

Column 1, line 57, delete "Primary" and insert -- A primary"

Column 3, line 1, insert "·" over "m" in "$m_D$";

Column 3, line 3, delete "10" and insert -- 10 --;

Column 4, line 2, delete "10" and insert -- 10 --;

Column 4, line 44, after "value", delete "is changed".

Signed and Sealed this

Nineteenth Day of October, 1993

Attest:

Bruce Lehman

BRUCE LEHMAN

Attesting Officer

Commissioner of Patents and Trademarks